US005627146A

United States Patent [19]

Tanaka et al.

[11] Patent Number: 5,627,146

[45] Date of Patent: May 6, 1997

[54] LUBRICATING OIL COMPOSITION

[75] Inventors: Noriyoshi Tanaka; Aritoshi Fukushima; Yukio Tatsumi; Yoko Saito, all of Tokyo, Japan

[73] Assignee: Asahi Denka Kogyo K.K., Tokyo, Japan

[21] Appl. No.: 579,163

[22] Filed: Dec. 27, 1995

[30] Foreign Application Priority Data

Dec. 27, 1994 [JP] Japan ..... 6-325890

[51] Int. Cl.[6] ..... C10M 135/18

[52] U.S. Cl. ..... 508/363; 508/364; 508/365; 508/379

[58] Field of Search ..... 252/42.7, 46.4; 508/363

[56] References Cited

U.S. PATENT DOCUMENTS

| | | | |
|---|---|---|---|
| 3,356,702 | 12/1967 | Farmer et al. | 252/42.7 |
| 3,509,051 | 4/1970 | Farmer et al. | 252/46.4 |
| 3,840,463 | 10/1974 | Froeschmann et al. | 252/42.7 |
| 4,178,258 | 12/1979 | Papay et al. | 508/363 |
| 4,395,343 | 7/1983 | deVries et al. | 252/46.4 |
| 4,957,651 | 9/1990 | Schwind | 508/331 |
| 5,281,347 | 1/1994 | Igarashi et al. | 252/46.4 |
| 5,356,547 | 10/1994 | Arai et al. | 252/46.4 |
| 5,494,608 | 2/1996 | Kamakura et al. | 252/47.7 |

FOREIGN PATENT DOCUMENTS

| | | |
|---|---|---|
| 0205165 | 12/1986 | European Pat. Off. . |
| 0208541 | 1/1987 | European Pat. Off. . |
| 0527024 | 2/1993 | European Pat. Off. . |
| 48-56202 | 8/1973 | Japan . |
| 53-121727 | 10/1978 | Japan . |
| 4113604 | 9/1979 | Japan . |
| 6095990 | 8/1981 | Japan . |
| 61-87690 | 5/1986 | Japan . |
| 61-106587 | 5/1986 | Japan . |
| 62-81396 | 4/1987 | Japan . |
| 62-190295 | 8/1987 | Japan . |
| 63-46297 | 2/1988 | Japan . |
| 1-95194 | 4/1989 | Japan . |
| 3-41193 | 2/1991 | Japan . |
| 3-153794 | 7/1991 | Japan . |
| 3-281695 | 12/1991 | Japan . |
| 5-163497 | 6/1993 | Japan . |
| 5186787 | 7/1993 | Japan . |
| 5-230485 | 9/1993 | Japan . |
| 5-279686 | 10/1993 | Japan . |
| 94-28094 | 12/1994 | WIPO . |

*Primary Examiner*—Ellen M. McAvoy

*Attorney, Agent, or Firm*—Oblon, Spivak, McClelland, Maier & Neustadt, P.C.

[57] ABSTRACT

The present invention is directed to providing a lubricating oil composition which contains an alkyl group asymmetric type molydbdenum dithiocarbamate (MoDTC) as an essential component thereof and which exhibits far more excellent lubrication performance than a conventional lubricating oil composition containing an alkyl group symmetric type MoDTC conventional used in the field of lubricating oils. The lubricating oil composition according to the present invention comprises a base oil for a lubricating oil consisting of a mineral oil and/or a synthetic oil and having a viscosity index of at least 115 and a viscosity at 100° C. falling within the range of 2 to 50 cSt, and a specific alkyl group asymmetric type MoDTC as an essential component.

14 Claims, No Drawings

LUBRICATING OIL COMPOSITION

BACKGROUND OF THE INVENTION

1. Field of the Invention

This invention relates to a lubricating oil composition. More particularly, the present invention relates to a lubricating oil composition which comprises a base oil for a lubricating oil and a specific molybdenum dithiocarbamate, has high stability over a long period of time, and has consistently excellent lubricating performance from the initial stages of use until even after its degradation.

2. Description of the Prior Art

In recent years, increasingly compact and maintenance-free lubricating system with higher performance have been required for lubricating systems. Also, required are a reduction in energy loss and an improvement in mechanical efficiency so as to meet recent energy saving trends.

Lubricating oil degrades over time due to exposure to physical shearing forces, high temperatures, high pressures and an oxidizing atmosphere during use. Though a portion of the additives added to the lubricating oil exhibits extreme pressure performance as in the case of an extreme pressure agent, the major proportion of additives oxidizes and degrades under the conditions described above, thereby decomposing and in some cases even changing into sludge, before exhibiting extreme pressure performance.

In internal combustion engines, in particular, blow-by gases such as $NO_x$, $SO_x$, hydrocarbons, and so forth, mix with the base oil, creating even harsher degradation conditions.

Attempts have been made in recent years to improve the temperature/viscosity characteristics of the base oil itself in order to improve the problems of wear and seizure at high temperatures and the problem of the energy loss at low temperatures. Refined mineral oils and synthetic oils prepared by chemical means have been used as the base oil, but the problem of decreased thermal stability of the base oil for a lubricating oil develops because those impurities contained in the mineral oils which have oxidation prevention functions such as sulfur compounds, nitrogen compounds, etc. are eliminated. A still greater problem is that base oils for lubricating oils which comprise a mineral oil and/or a synthetic oil, the viscosity index of which is at least 115 and the viscosity of which is within the range of 2 to 50 cSt at 100° C. (hereinafter referred to as the "high VI Oil") have a high paraffin content and for this reason, solubility of additives in the lubricating oil is likely to decrease.

Molybdenum dithiocarbamate (hereinafter referred to as "MoDTC") has been used as an excellent additive for improving wear and friction under such conditions. However, because MoDTC has low solution stability in the high VI oils and the synthetic oils described above and as it may also function as an antioxidant, lubricating oils using MoDTC have low oxidation stability and are likely to fail to exhibit their lubricating characteristics.

In consideration of the object of reducing energy loss, a composition which allows MoDTC to optionally exhibit its function as a friction regulator but not as an antioxidant is very important.

Lubricating oil compositions which accomplish savings in fuel costs during the initial stages have been developed, but studies on such compositions have been mainly directed to new oils which have not yet begin to degrade, and studies on the durability of the additives are still scarce- Because lubricating oils degrade over time with use as described above, the effect of savings in fuel cost cannot be sufficiently obtained unless the low friction and low wear properties are maintained over a long period of time.

Japanese Patent Laid-Open No.62-81396, for example, proposes a molybdenum-containing lubricant additive with an excellent oxidation preventive function, wear proofing function, friction mitigating function and metal corrosion inhibiting function, and further is highly soluble in a base oil such as a mineral oil. Japanese Patent Laid-Open No.48-56202 proposes an extreme pressure lubricant containing MoDTC blended thereto.

Further, Japanese Patent Laid-Open No.5-279686 proposes a lubricating oil composition for an internal combustion engine prepared by blending (a) sulfurized oxymolybdenum dithiocarbamate and/or sulfurized oxymolybdenum organophosphorodithioate, (b) fatty acid ester and/or organoamide compound, (c) at least one compound selected from the group consisting of calcium sulfonate, magnesium sulfonate, calcium phenate and magnesium phenate, (d) at least one compound selected from the group consisting of benzylamine and boron derivatives of benzylamine, and (e) zinc dithiophosphate and/or zinc dithiocarbamate, in a base oil for a lubricating oil.

Japanese Patent Laid-Open No.5-230485 proposes a lubricating oil composition for an engine oil containing, as essential components in a base oil using a mineral oil and/or a synthetic lubricating oil, (a) an alkaline earth metal salt of alkylsalicylic acid, (b) a his-type alkenylsuccinic acid imide having a polybutenyl group and/or its derivative, and (c) sulfurized oxymolybdenum organophosphorodithioate and/or molybdenum dithiocarbamate.

Japanese Patent Laid-Open No.5-186787 proposes a lubricating oil composition prepared by blending (a) sulfurized oxymolybdenum dithiocarbamate and/or sulfurized oxymolybdenum organophosphorodithioate and (b) zinc dithiophosphate and/or zinc dithiocarbamate into a mineral oil, and further proposes a lubricating oil composition prepared by adding (c) an organic amide compound to the above.

Japanese Patent Laid-Open No.5-163497 proposes an engine oil composition comprising (A) a base oil consisting of a mineral oil and/or a synthetic oil, (B) a boron compound derivative of alkenylsuccinic acid imide, (C) an alkaline earth metal salt of salicylic acid and (D) molybdenum dithiophosphate and/or molybdenum dithiocarbamate, as the principal components.

However, none of the prior art technologies described above have succeeded in solving the great problems of molybdenum compounds, particularly MoDTC. In other words, the problems of the solubility of the MoDTC itself in a high VI oil of its residuary properties after oxidation and degradation, and of the extreme pressure properties of the lubricating oil composition after degradation (wear resistance during high load), still remain unsolved. The problem of solubility in a high VI oil being a particularly great problem.

SUMMARY OF THE INVENTION

It is therefore a main object of the present invention to provide a lubricating oil composition containing an alkyl group asymmetric type MoDTC which exhibits far higher lubrication performance after degradation than lubricating oil compositions containing an alkyl group symmetric type MoDTC as used in the past in the lubricating oil industry.

The present invention provides a lubricating oil composition which solves the technical problems of the prior art such as solubility in high VI oils, residuary properties after oxidation and degradation, wear resistance of the lubricating oil composition after degradation, etc, and which exhibits hitherto unknown excellence in lubrication performance, by using an alkyl group asymmetric type NoDTC having at least two different kinds of alkyl groups. The present invention further provides a lubricating oil composition having an even more excellent lubricating oil composition by blending various additives into the alkyl group asymmetric type MoDTC.

In other words, the present invention provides a lubricating oil composition which comprises a high VI oil consisting of a mineral oil and/or a synthetic oil having a viscosity index (VI) of at least 115 and a viscosity at 100° C. within the range of 2 to 50 cSt, and a molybdenum dithiocarbamate expressed by the following general formula (1) as Component (A):

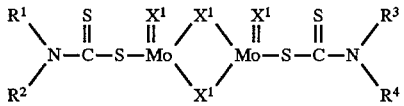

(1)

wherein both of $R^1$ and $R^2$ each represent a $C_8$ to $C_{13}$ alkyl group having a branched chain, each of $R^3$ and $R^4$ each represent $C_8$ to $C_{13}$ alkyl group having a branched chain and/or straight chain, with the provision that none of $R^1$ to $R^4$ are simultaneously the same, and $X^1$ represents a sulfur atom or an oxygen atom.

The present invention also provides a lubricating oil composition containing at least one of Components (B) to (K) listed below based on 100 parts by weight of the high VI oil in the lubricating oil composition described above:

Component (B): 0.05 to 2 parts by weight of at least one kind of phenolic compound;

Component (C): 0.05 to 2 parts by weight of at least one kind of aromatic amine compound;

Component (D): 0.01 to 3 parts by weight of at least one kind of zinc dithiophosphate (hereinafter referred to as "ZDTP");

Component (E): 0.1 to 10 parts by weight of at least one kind of metal detergent;

Component (F): 0.05 to 15 parts by weight of at least one kind of ashless dispersant;

Component (G): 0.1 to 10 parts by weight of at least one kind of polyol half ester (whose alcoholic hydroxyl groups are not partly esterified);

Component (H): 0.01 to 5 parts by weight of at least one kind of carboxylic acid amide;

Component (J): 0.01 to 1 parts by weight of at least one kind of molybdenum dithiophosphate (hereinafter referred to as "MoDTP"); and Component (K): 0.01 to 1 parts by weight of at least one kind of molybdic amine salt.

The high VI oil as the base oil for a lubricating oil in the lubricating oil composition according to the present invention comprises a mineral oil and/or a synthetic oil which has a viscosity index of at least 115 and the viscosity of which at 100° C. is within the range of 2 to 50 cSt.

Here, the term "mineral oil" means those oils which are separated from natural crude oils and are distilled and refined. Examples of such mineral oils include paraffin type oils and naphthene type oils or those oils which are obtained by hydrogenating and refining the same with solvents. The term "synthetic oil" means those lubricating oils which are chemically synthesized, and examples include poly-alpha-olefins, polyisobutylene (polybutene), diesters, polyol esters, phosphoric acid esters, silicic acid esters, polyalkylene glycols, polyphenyl ethers, silicones, fluorine compounds, alkylbenzene, and so forth. Among these, those lubricating oils which have a viscosity index of at least 115 can be used as the base oil for the lubricating oil in the present invention. The viscosity of the high VI oil at 100° C. is from 2 to 50 cSt and preferably from 2 to 30 cSt. If the viscosity is below this range, oil film formation by the high VI oil becomes insufficient, which results in wear and seizure. If the viscosity exceeds this range, power loss is likely to increase due to the viscous resistance.

Among the mineral oils described above, particularly preferred are those whose aromatic components and whose sulfur components are reduced to below 5% and 100 ppm, respectively, by hydrorefining. Since the aromatic components and sulfur components reduce the effects of MoDTC and other additives, their contents are preferably reduced below the range described above by hydrorefining.

Among the synthetic oils described above, poly-alpha-olefins synthesized from $C_4$ to $C_{16}$ alpha-olefins and having a molecular weight of 300 to 2,500 can be preferably used. Examples of such $C_4$ to $C_{16}$ alpha-olefins include butylene, 1-hexene, 1-octene, 1-decene, 1-tetradecene, and so forth. Poly-alpha-olefins are produced by oligomerizing these alpha-olefins and appropriately conducting hydrogenation. Lewis acid, Ziegler catalysts, Ziegler-Natta catalysts, etc, are employed during oligomerization. Synthetic oils prepared from alpha-olefins other than $C_4$ to $C_{16}$ alpha-olefins and those which have a molecular weight other than a molecular weight of 300 to 2,500 are not preferred because of an increased fluidization point. Synthetic oils prepared from olefins other than alpha-olefins, that is, internal olefins, cannot be used as the base oil for the lubricating oil according to the present invention because their viscosity index is too low. Due to their constant molecular structure, poly-alpha-olefins have lubrication properties which superior to those of unprocessed mineral oils, making the effects of additives particularly remarkable.

Polyol esters having a molecular weight of 200 to 1,200 may also be preferably used. The term "polyol ester" represents those esters which are produced from polyhydric alcohols and mono- or polyvalent carboxylic acids by ordinary experimental or industrial production processes.

Particularly preferred among the polyhydric alcohols are hindered alcohols (the hydroxyl group of which has a quaternary carbon at its β position). Examples of such polyhydric alcohols include neopentyl glycol, trimethylolethane, trimethylolpropane, pentaerythritol, dipentaerythritol, tripentaerythritol and their alkylene oxide adducts.

Compounds having 4 to 16 carbon atoms are preferred among the mono- or polyvalent carboxylic acids. Examples of such compounds are burytic acid, isobutyric acid, valeric acid, isovaleric acid, pivalic acid, capric acid, caproic acid, caprylic acid, lauric acid, myristic acid, palmitic acid, oxalic acid, malonic acid, succinic acid, glutaric acid, adipic acid, pimelic acid, suberic acid, azelaic acid, sebacic acid, methacrylic acid, crotonic acid, isocrotonic acid, oleic acid, fumaric acid, maleic acid, benzoic acid, toluic acid, phthalic acid, naphthoic acid, and so forth. Preferred among them are butyric acid, isobutyric acid, valeric acid, isovaleric acid, pivalic acid, capric acid, caproic acid, caprylic acid, lauric acid, myristic acid and palmitic acid.

Diesters having a molecular weight of 200 to 700 are also preferably used. The term "diester" represents those esters which have two ester bonds inside one molecule and which are produced from monohydric alcohol and dibasic acid by ordinary experimental or industrial processes. Such a monohydric alcohol may be a straight chain or branched chain alcohol. The dibasic acids preferably have 6 to 12 carbon atoms and examples of such dibasic acids are adipic acid, azelaic acid, sebacic acid and dodecanic diacid.

These high VI oils may be used either alone or in mixture of at least two kinds.

The MoDTC used for the present invention is the compound expressed by the following general formula (1):

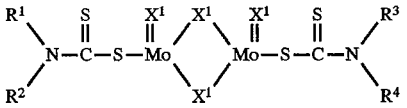

(1)

In the general formula (1) given above, $R^1$ and $R^2$ are $C_8$ to $C_{13}$ alkyl groups having a branched chain, and they may be saturated or unsaturated. Examples include 2-ethylhexyl groups and isotridecyl groups. $R^3$ and $R^4$ are branched chain or straight chain $C_8$ to $C_{13}$ alkyl groups, and they may be saturated or unsaturated. Examples include n-octyl groups, 2-ethylhexyl groups, isononyl groups, n-decyl groups, isodecyl groups, dodecyl groups, tridecyl groups and isotridecyl groups. Particularly preferred are those MoDTCs in which $R^1$ and $R^2$ are 2-ethylhexyl groups and $R^3$ and $R^4$ are dodecyl group and/or isotridecyl group.

In the general formula (1) given above, all of $R^1$ to $R^4$ must not be the same. Preferably, $R^1$ and $R^2$ are the same and $R^3$ and $R^4$ are the same, with $R^1$ and $R^2$ being different alkyl groups from the alkyl groups of $R^3$ and $R^4$. When all the alkyl groups are the same or, in other words, when the MoDTC is of the alkyl group symmetric type, its solubility in a high VI oil is low, and the MoDTC does not stably exist in the base oil but precipitates during long-term storage. Accordingly, when a lubricating oil composition containing the alkyl group symmetric type MoDTC is used, clogging and frictional wear are likely to occur in pumps and strainers. Therefore, such a lubricating oil composition is not preferable. Particularly in a combination system with ZDTP, oxidation stability and friction regulation capacity decrease remarkably. When the lubricating oil composition degrades due to use, the alkyl group symmetric type MoDTC easily decomposes if a high VI oil is the base oil for the lubricating oil, so that a sufficient amount does not remain in the base oil after degradation. Consequently, when an alkyl group symmetric type MoDTC is added to a lubricating oil, friction reducing effects can be obtained immediately after initiation of use, but as the time of use proceeds and the lubricating oil begins to degrade, the MoDTC soon decomposes and sufficient friction reducing effects can no longer be obtained.

In contrast, the alkyl group asymmetric type MoDTC has sufficiently high solubility in the base oil of a lubricating oil, particularly in a high VI oil, due to its asymmetry, and can stably exist in the base oil. Because of this stability, this MoDTC can exist in sufficient quantities even with the degradation of the lubricating oil composition, and a sufficient friction reducing effect can be obtained. Accordingly, the service life of the lubricating oil composition can be prolonged or, in other words, long drain can be accomplished. For this reason, the alkyl group asymmetric type MoDTC used in the present invention is by far superior to the alkyl group symmetric type MoDTC for use as the MoDTC that is added to the high VI oil.

In the general formula (1), $X^1$ is a sulfur atom or an oxygen atom. In order to improve corrosion resistance and solubility in the base oil, the ratio of the sulfur atom to the oxygen atom (S/O) is 1/3 to 3/1 and more preferably, 1.5/2.5 to 3/1.

Preferably, 0.01 to 3 parts by weight of the alkyl group asymmetric type MoDTC used as the essential component of the lubricating oil composition of the present invention and expressed by the general formula (1) is added per 100 parts by weight of the high VI oil. However, the amount added may be appropriately determined in accordance with the conditions of use and the application of the lubricating oil. Having high solubility in the high VI oil, the range wherein the added amount of the alkyl group asymmetric type MoDTC is effective is broader than the alkyl group symmetric type MoDTC, and long term storage properties are not at all hindered even when a greater amount of the alkyl group asymmetric type MoDTC is added.

The alkyl group asymmetric type MoDTC used for the present invention is preferably produced by the method disclosed in for example Japanese Patent Laid-Open No.62-81396. In other words, this MoDTC can be prepared by reacting molybdenum trioxide or molybdate with an alkali sulfide or an alkali hydrosulfide, then adding carbon disulfide and a secondary amine, and allowing the reaction to proceed at a suitable temperature. In order that the alkyl group be asymmetric, a secondary amine having different alkyl groups or two or more kinds of different secondary amines may be used.

The phenolic compound used as Component (B) for the lubricating oil composition of the present invention is directed primarily to the prevention of oxidation/degradation of the lubricating oil, and is not particularly limited as long as the compound has a phenolic hydroxy group. Particularly preferred are the phenolic compounds expressed by the general formula (2) or (3).

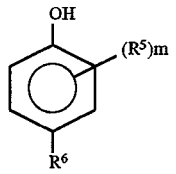

(2)

In the general formula (2). $R^5$ represents a hydrocarbon group such as a $C_1$ to $C_8$ alkyl group, alkenyl group, aryl group, and so forth. Specific examples of such hydrocarbon groups include the methyl group, ethyl group, propyl group, isopropyl group, butyl group, isobutyl group, tert.-butyl group, pentyl group, tert.-pentyl group, hexyl group, heptyl group, octyl group, 2-ethylhexyl group, etc. Among these, the methyl group, isopropyl group, isobutyl group and tert.-butyl group are preferred. Since m is an integer of 2 to 4, two to four $R^5$s exist in the benzene nucleus. The plurality of $R^5$s may be independently the same or different, and the substitution position is not particularly limited, but it preferably occurs at the 2- and 6-positions with respect to the phenolic hydroxyl group. $R^6$ represents hydrocarbon groups such as a $C_1$ to $C_{24}$ alkyl group, alkenyl group, aryl group, etc, or those hydrocarbon groups which may contain an ester bond and an ether bond.

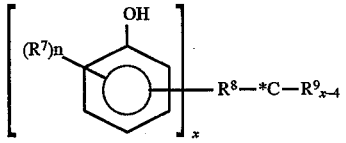

(3)

The compounds expressed by the general formula (3) given above are bis-, tris- and tetrakis-compounds of the compounds expressed by the general formula (2) or their derivatives. In the general formula (3), $R^7$ and $R^9$ are $C_1$ to $C_8$ hydrocarbon groups which may contain oxygen, and n is an integer of 2 to 4. The plurality of $R^7$s may be independently the same or different. Though the substitution position of $R^7$ is not particularly limited, the 2- and 6-positions are preferred with respect to the phenolic hydroxyl group. Since x is an integer of 2 to 4, the plurality of phenol derivatives inside the parenthesis may be independently the same or different. $R^8$ represents hydrocarbon groups which have 1 to 24 carbon atoms and which may contain an oxygen atom. However, $R^8$ may be absent and in this case, the carbon atom expressed by *C is directly bonded to the benzene nucleus.

The compounds expressed by the general formula (2) or (3) include the compounds which are referred to as the "hindered phenols".

The phenolic compounds used as Component (B) in the present invention include, for example, 2,6-di-tert.-butyl-p-cresol, 4,4'-methylenebis(2,6-di-tert.-butylphenol), 3-tert.-butyl-4-hydroxyanisole, 2-tert.-butyl-4-hydroxyanisole, 2,5-di-tert.-butylhydroquinone, 2,5-di-tert.-pentylhydroquinone, bis-phenol A, alkylated bis-phenol A and polyalkylated bis-phenol A. Further, examples of the phenolic compounds include the compounds expressed by the formulas (14) to (19) listed below:

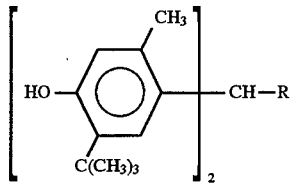

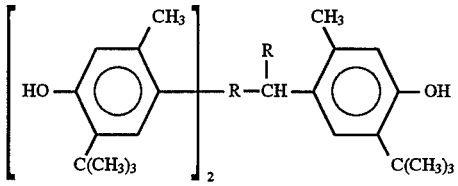

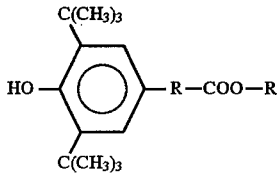

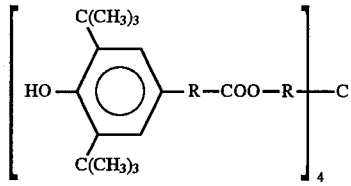

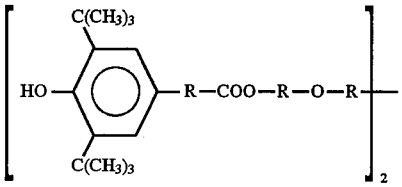

-continued

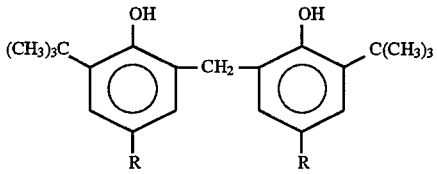

In the chemical formulas given above, R represents an arbitrary alkyl or alkylene group.

In addition, the hindered phenol derivatives containing a sulfur atom, a nitrogen atom and a phosphorus atom can also be used. Examples of such derivative include 4,4'-thiobis(3-methyl-6-tert.-butylphenol), 4,4'-thiobis(2-methyl-6-tert.-butylphenol), tris(3,5-di-tert.-butyl-4-hydroxyphenyl) propionyloxyethyl ioscyanurate, tris(3,5-di-tert.-butyl-4-hydroxyphenyl) isocyanurate, 1,3,5-tris(3',5'-di-tert.-butyl-4-hydroxybenzoyl) isocyanurate, bis[2-methyl-4-(3-n-alkylthiopropyonyloxy)-5-tert.-butyl-phenyl] sulfide, 1,3,5-tris(4-di-tert.-butyl-3-hydroxy-2,6,-dimethylbenzly) isocyanurate, tetraphthaloyl-di(2,6-dimethyl-4-tert.-butyl-3-hydroxybenzyl sulfide), 6-(4-hydroxy-3,5-di-tert.-butylanilino)-2,4-bis(octylthio)- 1,3,5-triazine, 2,2-thio-[diethyl-bis-3-(3,5-di-tert.-butyl-4-hydroxyphenyl) propionate], N,N'-hexamethylene-bis(3,5-di-tert.-butyl-4-hydroxy-hydrocinnamide), 3,5-di-tert.-butyl-4-hydroxy-benzyl-phosphric acid diester, bis(3-methyl-4-hydroxy-5-tert.-butylbenzyl)sulfide, etc.

The amount of addition of the phenolic compound as the component(B) added per 100 parts by weight of the high VI oil is 0.05 to 2 parts by weight. When the amount added is below this range, the oxidation/degradation prevention effects of the lubricating oil cannot be obtained and, moreover, adverse influences are exerted on the remaining quantity of the alkyl group asymmetric type MoDTC during long-term use. When the amount added exceeds this range, effects exceeding a predetermined level cannot be obtained and, in some cases, the adverse effect of an increased frictional coefficients is generated.

Because the phenolic compound as the (B) component is added, the lubricating oil composition according to the present invention prevents oxidation/degradation of the lubricating oil base oil itself, and because it restricts the oxidation decomposition of the alkyl group asymmetric type MoDTC, it exhibits excellent lubricating properties even after degradation. Accordingly, the use of the phenolic compound in combination with the alkyl group asymmetric type MoDTC is preferred so as to accomplish long drain of the lubricating oil.

The aromatic amine type compounds used as Component (C) in the lubricating oil composition of the present invention are directed mainly to the prevention of oxidation/degradation of the lubricating oil. Examples of such compounds are phenylamine, alkyl-substituted phenylamine, naphthylamine, alkyl-substituted naphthyamine, phenothiazine, alkyl-substituted phenothiazine, N-alkyl-substituted phenothiazine, phenoselenazine, alkyl-substituted phenoselenazine, carbazole, alkyl-substituted carbazole, N-alkyl-substituted carbazole, pyridine, alkyl-substituted pyridine, N-alkyl-substituted pyridine, quinoline, alkyl-substituted quinoline, N-alkyl-substituted quinoline, benzidine, alkyl-substituted benzidine, N-alkyl-substituted benzidine, acridine, alkyl-substituted acridine, N-alkyl-substituted acridine, and their derivatives. Particularly preferred among these are the compounds expressed by the general formula (4):

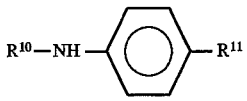

(4)

In the formula (4), $R^{10}$ and $R^{11}$ represent $C_1$ to $C_{20}$ alkyl groups or aryl groups, naphthyl groups, alkyl-substituted aryl groups, alkyl-substituted naphtyl groups, heterocyclic ring-containing substituted groups (such as pyridine ring), etc.

Specific examples include phenyl-1-naphthylamine, pheny-2-naphthylamine, diphenyl-p-phenylenediamine, di-pyridylamine, diphenylamine, p,p'-dioctyldiphenyamine, methylbenzylphenyl urea, 4,4'-methylenebis(N,N'-dimethyl-aniline), 1,4-diamino(2-butyl)bezene, and their derivatives.

The amount of the aromatic amine compounds as Component (C) added per 100 parts by weight of the high VI oil is 0.05 to 2 parts by weight. When the amount is below this range, the oxidation/degradation prevention effects of the lubricating oil cannot be obtained and, moreover, adverse influences are exerted on the remaining quantity of the alkyl group asymmetric type MoDTC during long-term use. When the amount exceeds this range, effects exceeding a predetermined level cannot be obtained, and, in some cases, the adverse effect of an increased frictional coefficient is generated.

Because the aromatic amine compound as Component (C) is added, the lubricating oil composition according to the present invention prevents oxidation/degradation of the base oil for the lubricating oil itself, but it also restricts oxidation decomposition of the alkyl group asymmetric type MoDTC, so that it exhibits excellent lubricating properties even after degradation. Therefore, the use of the aromatic amine type compound in combination with the alkyl group asymmetric type MoDTC is preferred so as to accomplish long drain of the lubricating oil.

ZDTP used as Component (D) in the lubricating oil composition of the present invention is primarily used as an extreme pressure additive, and also has the function of preventing oxidation. This ZDTP is expressed by the general formula (5):

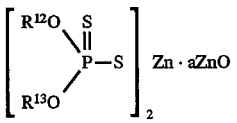

(5)

In the general formula (5), $R^{12}$ and $R^{13}$ are alkyl groups having 3 to 14 carbon atoms, and $R^{12}$ and $R^{13}$ may be the same or different. Specific examples of such alkyl groups include the propyl group, butyl group, isobutyl group, pentyl group, isopentyl group, hexyl group, heptyl group, octyl group, 2-ethylhexyl group, nonyl group, decyl group, undecyl group, dodecyl group, tridecyl group, isotridecyl group, and so forth. Among these, the hexyl group, octyl group, 2-ethylhexyl group and dodecyl group are preferred.

At least 60% of the one or more kinds of $R^{12}$ and $R^{13}$ in the ZDTPs used are preferably the primary alkyl group. The remaining 40% or below may be secondary and/or tertiary alkyl groups.

Symbol a represents 0 or 1/3. When a=0, ZDTP is called a "neutral ZDTP" and when a=1/3, it is called a "basic ZDTP".

The ZDTP used in the present invention can be produced by the method described, for example, in Japanese Patent Publication No.48-37251. That is, alkyl-substituted dithiophosphoric acid is first prepared by reacting $P_2S_5$ with a desired alcohol and is then converted to a neutral or base by zinc oxide to thereby form a zinc salt.

The amount of addition of the ZDTP as Component (D) added per 100 parts by weight of the high VI oil is from 0.01 to 3 parts by weight, preferably from 0.3 to 2 parts by weight. When the amount is below this range, sufficient extreme pressure effects cannot be obtained. When the amount exceeds the range, catalysts of exhaust gas processing apparatuses are poisoned because the ZDTP contains phosphorus (P).

Because the ZDTP as Component (D) is added, the lubricating oil composition according to the present invention not only prevents oxidation/degradation of the base oil itself but also restricts the oxidation decomposition of the alkyl group asymmetric type MoDTC, so that it exhibits excellent lubrication performance even after degradation. Accordingly, the use of the ZDTP in combination with the alkyl group asymmetric type MoDTC is preferred so as to make the lubricating oil long drain.

The metal detergent used as Component (E) in the lubricating oil composition of the present invention is a neutral, basic or ultrabasic, organic or inorganic salt. The detergent is the additive which prevents and restricts deposition of the degraded matters in the lubricating oil under high temperature conditions and keeps the lubricating oil clean. Among these, metal sulfonates, metal phenates and metal salicylates are preferred.

The metal sulfonates are expressed by the following general formula (10):

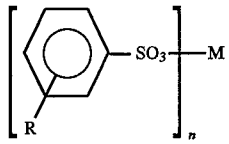

(10)

The metal phenates are expressed by the following general formula (11):

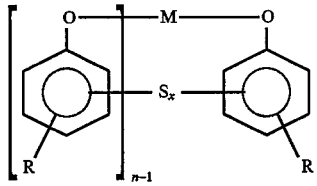

(11)

The metal salicylates are expressed by the following general formula (12):

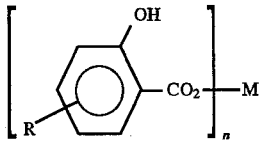

(12)

In the general formulas (10), (11) and (12), R is a hydroxy group, a $C_1$ to $C_{24}$ hydrocarbon group or an aromatic ring condensed with a benzene nucleus. M is n-valent metal, and x is preferably from 1 to 5.

Specific examples of the compounds expressed by general formulas (10), (11) and (12) include lithium dinonylnaphthalene sulfonate, sodium dinonylnaphthalene sulfonate, zinc dinonylnaphthalene sulfonate, aluminum dinonylnaphthalene sulfonate, magnesium dinonylnaphthalene sulfonate, calcium dinonylnaphthalene sulfonate, barium dinonylnaphtalene sulfonate, sodium tribenzylmethylbenze sulfonate, potassium tribenzylmethylbenzene sulfonate, sodium-2,6-dioctylnaphthalene-1-sulfonate, sodium 2,6-didodecylnaphthalene sulfonate, magnesium dodecyl salicylate, magnesium hexadecyl salicylate, calcium dodecyl salicylate, calcium hexadecyl salicylate, barium dodecyl salicylate, barium hexadecyl salicylate, magnesium nonylphenate, calcium nonylphenate, barium nonylphenate, etc. Among these, salts having calcium and magnesium are preferred, and ultrabasic calcium sulfonate, neutral, sulfonate, calcium phenate and calcium salicylate are further preferred.

The metal detergent used for the lubricating oil composition according to the present invention is preferably produced by the methods disclosed in Japanese Patent Laid-Open Nos.3-281695, 3-153794, 67-96598, 63-46297, 62-190295, 53-121727, etc.

The amount of the metal detergent as Component (E) added is 0.1 to 10 parts by weight, preferably 0.4 to 3.5 parts by weight, on the basis 100 parts by weight of the high VI oil. If the amount added is below this range, corrosion resistance is not sufficient, wear increases and the amount of sludge formed also increases. Hence, such an amount is not preferable for the lubricating oil. If the amount added exceeds the range, the adverse effect of an increased coefficient of friction is generated.

When the metal detergent as the component (E) is added, deposition of the degraded matters in the high VI oil can be prevented and restricted. Therefore, it is preferable to use the metal in combination with the alkyl group asymmetric type MoDTC in order to allow this MoDTC to fully exhibit its functions and to accomplish long drain of the lubricating oil.

The ashless dispersants used as Component (F) of the lubricating oil composition according to the present invention are compounds containing basic nitrogen in the molecules thereof and polyol carboxylic acid esters. They are the additives which disperse the sludge generated under low temperature lubricating conditions into the oil.

Among them, alkenylsuccinic acid imide expressed by the following general formula (14) is preferably used:

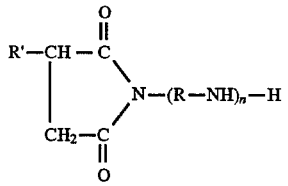

(14)

In the formula (14), R is a $C_1$ to $C_8$ alkene group, R' is an alkylene group, and a polybutenyl group is preferred. Alternatively, their bis-compounds, and those obtained by reacting them with boron compounds, aldehydes, ketones, carboxylic acids, sulfonic acids, alkylene oxides, sulfur, etc, can be preferably used.

Benzylamine synthesized from polybutene, phenol, formaldehyde, polyamine, etc, by the Mannich reaction may also be preferably used. A typical structure of such a benzylamine is expressed by the following general formula (15):

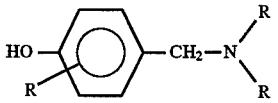

(15)

In the formula (15), R is an arbitrary hydrocarbon group.

Succinic acid esters prepared from polyols and succinic anhydride are also preferably used. Examples of such polyols include neopentyl glycol, trimethylolethane, trimethtlolpropane, pentaerythritol, dipentaerythritol, ethylene glycol, propylene glycol, glycerine, sorbitol, and so forth.

Preferred among these compounds are benzylamine, benzylamine boron derivatives, alkenylsuccinic acid imide, and alkenylsuccinic acid imide boron derivatives.

The ashless dispersant used in the present invention is preferably prepared by the methods disclosed, for example, in Japanese Patent Laid-Open Nos.3-41193 and 1-95194.

The amount of the ashless dispersant added based on 100 parts by weight of the high VI oil is 0.05 to 15 parts by weight, preferably 0.4 to 6 parts by weight. If the amount is below this range, the amount of the sludge formed increases and such an amount is not preferred in a in a lubricating oil. When the amount exceeds this range, the adverse effect of an increased coefficient of friction is generated.

When the ashless dispersant is added, the sludge can be dispersed in the oil, and performance of the alkyl group asymmetric type MoDTC can be fully exhibited. Further, because the lubricating oil can be made to be made to be long drain, the combined use of such an ashless dispersant is preferred.

The polyol half esters used as the component (G) in the lubricating oil composition of the present invention are mainly used as extreme pressure agents. As already described, the term "polyol half ester" represents esters of polyhydric alcohols, and means those esters wherein a part of the alcoholic hydroxyl group is not esterified. Such polyol half esters are synthesized by dehydration condensation of polyols and carboxylic acids, and can be produced by those method ordinarily employed both experimentally and industrially.

Preferred polyols are di- to hexahydric polyols, and definite examples include ethylene glycol, propylene glycol, butylene glycol, glycerin, pentirol, hexitol, neopentyl glycol, trimethylolethane, trimethylolpropane, pentaerythritol, dipentaerythritol, and their alkylene oxide adducts and caprolactone adducts.

The carboxylic acids are not particularly limited so long as they are mono- and polycarboxylic acids having 1 to 24 carbon atoms, and they may be aliphatic, aromatic, alicyclic, saturated or unsaturated. Examples of such carboxylic acids include acetic acid, propionic acid, burytic acid, isobutyric acid, valeric acid, isovaleric acid, pivalic acid, capric acid, caproic acid, caprylic acid, lauric acid, myristic acid, palmitic acid, stearic acid, oxalic acid, maloic acid, succinic acid, glutaric acid, adipic acid, pimelic acid, suberic acid, azelaic acid, sebacic acid, acrylic acid, propiolic acid, methacrylic acid, crotonic acid, isocrotonic acid, oleic acid, fumaric acid, maleic acid, benzoic acid, toluic acid, phthalic acid, naphthoic acid, and so forth. Among these, oleic acid and lauric acid are particularly preferred.

Among the polyol half esters described above, the polyol half esters expressed by the following general formula (6) are particularly preferred:

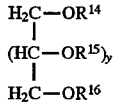

(6)

In the general formula (6) given above, y satisfies the relation $1 \leqq y \leqq 4$. $R^{14}$ to $R^{16}$ are a hydrogen atom, oleyl group or lauryl group, but all of $R^{14}$ to $R^{16}$ are not simultaneously a hydrogen atom, oleyl group or lauryl group. A plurality of $R^{15}$s at the time of $y \neq 1$ are mutually independent, and are either one of the hydrogen atom, oleyl group and lauryl group. Specific examples corresponding to the above general formula (6) include glycerin monooleate, glycerin monolaurate, glycerin dioleate, glycerin dilaurate, glycerin monooleate-monolaurate, sorbitol monolaurate, sorbitol dilaurate, sorbitol trilaurate, sorbitol tetralaurate, sorbitol monooleate, sorbitol dioleate, sorbitol trioleate, sorbitol tetraoleate, etc. Among these, glycerin monooleate, glycerin monolaurate, glycerin dioleate, glycerin dilaurate, sorbitol monolaurate, sorbitol dilaurate, sorbitol monooleate, sorbitol dioleate, sorbitol sesquilaurate and sorbitol sesquioleate are preferred.

The amount of addition of the polyol half ester as Component (G) is 0.1 to 10 parts by weight, preferably 1.5 to 2.5 parts by weight, on the basis of 100 parts by weight of the high VI oil. When the amount added is below this range, the friction reducing effect is not exhibited and therefor adding Component (G) has no meaning. If the amount exceeds this range, the problem if increased wear occurs.

The carboxylic acid amide as Component (H) in the lubricating oil composition according to the present invention is primarily used as an extreme pressure agent. The carboxylic acid amide is produced by dehydration-condensation of a carboxylic acid with ammonia, primary amine and secondary amine by the methods which are ordinarily employed experimentally and industrially.

Those carboxylic acids which are described in the description of the polyol half esters can similarly be used as the carboxylic acid.

The amines are not particularly limited, and alkylamines, alkenylamines, alkinylamines, aromatic amines, alicyclic amines, heterocyclic amines, etc, can be used without any particular limitations.

Among these amides, the compound expressed by the following general formula (7) is preferred:

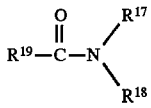

(7)

In the formula (7), each of $R^{17}$ and $R^{18}$ is a hydrogen atom or hydrocarbon group such as $C_1$ to $C_{24}$ alkyl groups, alkenyl groups, aryl groups, alkylaryl groups, etc, or $C_2$ to $C_{30}$ alkylene oxide. $R^{17}$ and $R^{18}$ may be the same or different. Specific examples include methyl group, ethyl group, propyl group, butyl group, isobutyl group, tert.-butyl group, pentyl group, isopentyl group, tert.-pentyl group, hexyl group, heptyl group, octyl group, 2-ethylhexyl group, nonyl group, decyl group, undecyl group, dodecyl group, tridecyl group, isotridecyl group, tetradecyl group, pentadecyl group, hexadecyl group, heptadecyl group, octadecyl group, phenyl group, toluyl group, xylyl group, cumenyl group, mesityl group, benzyl group, naphathyl group, and so forth. Examples of the alkylene oxides include ethylene oxide, propylene oxide, butylene oxide and their oligomers.

$R^{19}$ represents a hydrocarbon group such as $C_1$ to $C_{24}$ alkyl groups, alkenyl group, aryl group, alkylaryl group, etc. $R^{19}$ includes the same hydrocarbon groups as $R^{17}$ and $R^{18}$, and also the cis-9-heptadecyl group. These groups may be bonded by an ether bond, an ester bond or a carbonyl group. Furthermore, their hydrogen atom may be substituted by a hydroxyl group.

Oleic acid amide and lauric acid amide are preferred among these carboxylic acid amides.

The amount of addition of the carboxylic acid amide added as Component (H) is 0.01 to 5 parts by weight on the basis of 100 parts by weight of the high VI oil. When the amount is below this range, extreme pressure effects particularly at the initial stages of use cannot be obtained. When the amount of addition exceeds this range, the effects exceeding a predetermined level cannot be obtained and moreover, in some cases, the problem of an increased coefficient of friction occurs.

Component (J) in the lubricating oil composition according to the present invention is the MoDTP expressed by the following general formula (8). It is mainly used as a friction regulator and at the same time, has an oxidation preventive function.

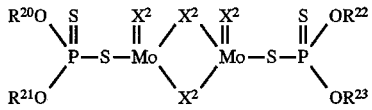

(8)

In general formula (8), $R^{20}$ to $R^{23}$ is each a $C_1$ to $C_{16}$ alkyl group, and may be the same or different Examples of such alkyl group include methyl group, ethyl group, propyl group, isopropyl group, butyl group, isobutyl group, tert.-butyl group, pentyl group, isopentyl group, tert.-pentyl group, hexyl group, 2-ethylbutyl group, heptyl group, octyl group, 2-ethylhexyl group, nonyl group, decyl group, undecyl group, dodecyl group, tridecyl group, isotridecyl group, and so forth. Among these, preferred are the 2-ethylbutyl group, 2-ethylhexyl group and isotridecyl group.

$X^2$ is a sulfur atom or an oxygen atom, and the ratio of sulfur atoms to oxygen atoms, that is, S/O, is preferably S/O=1/3 to 3/1 when taking into consideration the corrosion resistance.

The MoDTP expressed by the general formula (8) given above is preferably produced by the methods disclosed in Japanese Patent Laid-Open Nos.61-87690 and 61-106587, for example. In other words, the compounds can be obtained by reacting molybdenum trioxide or molybdate with an alkali sulfide or alkali hydrosulfide, and then continuing the reaction at a suitable temperature by adding $P_2S_5$ and a secondary alcohol.

The amount of addition of the HoDTP as Component (J) added is 0.01 to 1 part by weight, preferably 0.1 to 0.6 parts by weight, on the basis of 100 parts by weight of the high VI oil. When the amount added is below this range, sufficient friction regulating effects cannot be obtained. When the amount exceeds this range, the amount of sludge increases, or since MoDTP contains phosphorus, the catalyst of the exhaust gas processing apparatus will be poisoned.

Where higher lubrication performance is required, the MoDTP is preferably used in combination with the alkyl group asymmetric type MoDTC.

The MoAm as Component (K) of the lubricating oil composition according to the present invention is the compound expressed by the following general formula (9), and is added mainly as the friction regulator and the antioxidant.

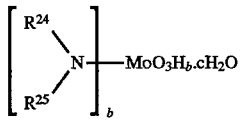

(9)

In the general formula (9) given above, $R^{24}$ and $R^{25}$ are $C_1$ to $C_{16}$ alkyl groups and may be the same or different. Such alkyl groups are similar to those which are illustrated in conjunction with the MoDTP, and the preferred examples for the MoDTP are also used preferably here.

The suffix b changes with the reaction conditions of the production, and compounds whose b is within the range of $0.95 \leqq b \leqq 1.05$ can be employed. On the other hand, c is a number satisfying the relation $0 \leqq c \leqq 1$. Since MoAm is a mixture of a hydrate type and a non-hydrate type, c must be within such a range.

MoAm as Component (K) is a salt of molybdic acid ($H_2MoO_4$) with a primary or secondary amine, and is preferably produced by the method described in Japanese Patent Laid-Open No.61-285293, for example. In other words, it can be obtained by reacting molybdenum trioxide or molybdate with a primary or secondary amine at a temperature ranging from room temperature to 100° C.

The amount of this MoAm added is 0.01 to 1 part by weight, preferably 0.05 to 0.6 parts by weight, on the basis of 100 parts by weight of the high VI oil. When the amount added is below this range, sufficient friction regulating effects cannot be obtained, and when it exceeds this range, sludge and friction undesirably increase.

Where higher lubrication performance is required, the MoAm is preferably used in combination with the alkyl group asymmetric type MoDTC.

In the lubricating oil composition according to the present invention, an antioxidant can be appropriately added. For example, appropriate sulfur type antioxidants are didodecylthiodipropionate, dioctadecylthiodipropionate, etc, appropriate phosphorus type antioxidants are triphenylphosphite, tricresylphosphite, tris(nonylphenyl) phosphite, etc, and appropriate antioxidants are a benzotriazole type, a thiadiazole type, a salicylidene type, etc.

Further, a suitable extreme pressure agent can be added to the lubricating oil composition of the present invention. Examples of the extreme pressure agents are sulfur type extreme pressure agents such as olefin suliides, dibenzyl disulfide, diphenyl disulfide, polyphenylene sulfide, etc; phosphorus type extreme pressure agents such as tricresyl phosphate, polyoxydialkyleneester phosphate, tributylphosphite, etc; and organometallic extreme pressure agents such as lead naphthenate, lead oleate, metal organodiphosphate, metal organodithiocarbamate, tetrabutyltitante, amine hexafluorotitanate, dibutyltin sulfide, dimetyldiethyl germanium, trimellitictin sulfide, tribenzyl borate, organomercaptoalkyl borate, etc.

Besides the metal detergent and the ashless dispersant described above, the lubricating oil composition according to the present invention can use metal phosphonates, and methacrylate type dispersants such as dialkylaminoethyl methacrylate, polyethleneglycol methacrylate, copolymers of vinylpyrrolidone and alkyl methacrylate, etc.

To improve low temperature fluidity, a fluidization point lowering agent can be appropriately added to the lubricating oil composition of the present invention depending on the application and the conditions of use of the composition.

The lubricating oil composition according to the present invention can be used as a lubricating oil for internal combustion engines including vehicle engines such as automobile engines, two-cycle engines, airplane engines, ship engines, locomotive engines (these engines are not limited and include gasoline engines, diesel engines, gas engines, turbine engines, etc), as automatic transmission liquids, as transmission axle lubricants, as gear lubricants, as metal machining lubricants, and so forth, and its performance is far more excellent than when the alkyl group asymmetric type MoDTC is used.

EXAMPLES

Hereinafter, the present invention will be explained in further detail with reference to Examples thereof, but is not particularly limited thereto.

Sample 1: Component (A)

Alkyl group asymmetric type MoDTC wherein $R^1$ and $R^2$ were an isotridecyl group, $R^3$ and $R^4$ were a 2-ethylhexyl group, and the ratio of the sulfur atom (S) to the oxygen atom (0) was S/O=2.2.

Sample 2: Component (A)

Alkyl group asymmetric type MoDTC wherein $R^1$ and $R^2$ were a tridecyl group, $R^3$ and $R^4$ were a 2-ethylhexyl group and S/O=1.5.

Sample 3: Component (B)

A phenolic compound expressed by the following formula:

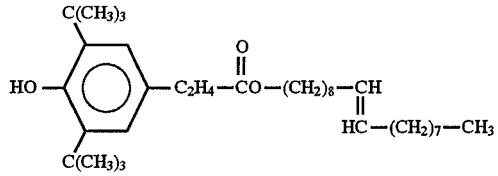

Sample 4: Component (B)

A phenolic compound expressed by the following formula:

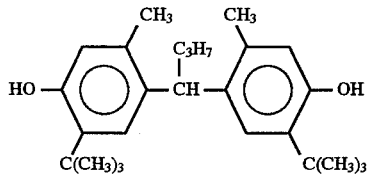

Sample 5: Component (B)

4,4'-methylenebis(2,6-di-tert.-butylphenol)

Sample 6: Component (B)

A phenolic compound expressed by the following formula:

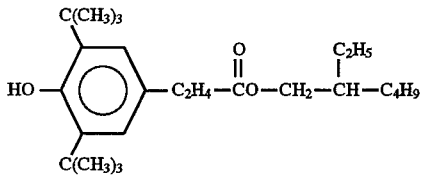

Sample 7: Component (C)

Phenyl-1-naphthylamine

Sample 8: Component (C)

p,p'-dioctyldiphenylamine

Sample 9: Component (D)

ZDTP of the general formula (5) wherein $R^{12}$ and $R^{13}$ were a 2-ethylhexyl group and the ratio of the neutral salt to the basic salt was 55:45.

Sample 10: Component (D)

ZDTP of the general formula (5) wherein $R^{12}$ and $R^{13}$ were a secondary hexyl group and the ratio of the neutral salt to basic salt was 97:3.

Sample 11: Component (D)

ZDTP of the general formula (5) wherein $R^{12}$ and $R^{13}$ were a secondary hexyl group and secondary propyl group, and the ratio of the neutral salt to the basic salt was 97:3.

Sample 12: Component (E)

Ca phenate

Sample 13: Component (E)

Ca sulfonate

Sample 14: Component (E)

Mg phenate

Sample 15: Component (F)

Benzylamine

Sample 16: Component (F)

Alkenylsuccinic acid imide

Sample 17: Component (F)
Boron derivative of alkenylsuccinic acid imide

Sample 18: Component (G)
Glycerin monooleate

Sampel 19: Component (G)
Glycerin dioleate

Sample 20: Component (G)
Glycerin monolaurate

Sample 21: Component (G)
Glycerin dilaurate

Sample 22: Component (G)
Sorbitan monooleate

Sample 23: Component (G)
Sorbitan dioleate

Sample 24: Component (G)
Sorbitan sesquioleate

Sample 25: Component (H)
Oleic acid amide

Sample 26: Component (J)
MoDTP of the general formula (8) wherein $R^{20}$ to $R^{23}$ were a 2-ethylhexyl group and S/O=1.

Sample 27: Component (J)
MoDTP of the general formula (8) wherein $R^{20}$ to $R^{23}$ were a secondary hexyl group and S/O=1.

Sample 28: Component (K)
MoAm of the general formula (9) wherein $R^{24}$ and $R^{25}$ were a isotridecyl group and b=1.05.

Sample 29: Alkyl group symmetric type MoDTC (Comparative Sample)
A compound wherein the Rs were a 2-ethylhexyl group, X was a sulfur atom or oxygen atom, and its S/O ratio was 2.2 in the following general formula (a):

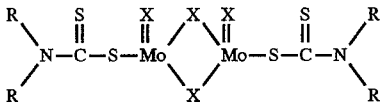

(a)

Sample 30: Alkyl group symmetric type MoDTC (Comparative Sample)
A compound of the general formula (a) described above wherein the Rs were an isotridecyl group and S/O=2.2.

Sample 31: Component (E)
Ca salicylate

Sample 32: Component (H)
Lauric acid amide

Sample 1-0: Base oil for lubricating oil
A mineral oil type high VI oil obtained by a hydrogenation decomposition process of a mineral oil obtained from a crude oil; viscosity=4.1 cSt at 100° C., VI=126.

Sample 1-1: Base oil for lubricating oil
A synthetic oil type high VI oil consisting of a diesther; viscosity=5.3 cSt at 100° C., VI=138, molecular weight=510.

Sample 1-2: Base oil for lubricating oil
A synthetic oil type high VI oil comprising 80% poly-alpha-olefin (viscosity=5.5 cSt at 100° C., VI=132, molecular weight=770) obtained by oligomerising 1-decene, and 20% of a polyol ester (viscosity=4.0 cSt at 100° C., VI=133, molecular weight=512.

Sample 1-3: Base oil for lubricating oil
A mineral oil/synthetic oil type high VI oil comprising 20% of the poly-alpha-olefin shown in Sample 1-2 and 80% of Sample 1-0.

Sample 1-4: Base oil for lubricating oil (Comparative Sample)
An oil which had a viscosity of 4.5 cSt at 100° C. and VI=104, and to which polymethacrylic ester was added as a viscosity index improving agent so as to raise the VI to 120.

Example I

<Solubility Stability Test>

Solubility stability was measured by dissolving a predetermined amount of the alkyl group asymmetric type MoDTC of Sample 1 or 2 or the alkyl group symmetric type MoDTC of Sample 29 or 30 in 100 parts by weight of the base oil for a lubricating oil, and then leaving the solution at room temperature. The results were tabulated as in Tables 1 and 2. In these Tables 1 and 2, the ○ mark denotes that no precipitation occurred for 30 days, the Δ mark denotes that precipitation occurred within 7 to 30 days, and the x mark denotes that precipitation occurred on the seventh day.

TABLE 1

| | Test No. | Base Oil Used | Sample No. | Amount Added (parts by weight) | Result |
|---|---|---|---|---|---|
| Example | 1 | 1-0 | 1 | 0.16 | ○ |
| | 2 | 1-0 | 1 | 0.6 | ○ |
| | 3 | 1-0 | 1 | 0.9 | ○ |
| | 4 | 1-0 | 1 | 1.5 | ○ |
| | 5 | 1-0 | 1 | 2.8 | ○ |
| | 6 | 1-1 | 1 | 0.16 | ○ |
| | 7 | 1-1 | 1 | 0.6 | ○ |
| | 8 | 1-1 | 1 | 0.9 | ○ |
| | 9 | 1-1 | 1 | 1.5 | ○ |
| | 10 | 1-2 | 2 | 0.16 | ○ |
| | 11 | 1-2 | 2 | 0.6 | ○ |
| | 12 | 1-2 | 2 | 0.9 | ○ |
| | 13 | 1-2 | 2 | 1.5 | ○ |
| | 14 | 1-3 | 2 | 0.16 | ○ |
| | 15 | 1-3 | 2 | 0.6 | ○ |
| | 16 | 1-3 | 2 | 0.9 | ○ |
| | 17 | 1-3 | 2 | 1.5 | ○ |

TABLE 2

| | Test No. | Base Oil Used | Sample No. | Amount Added (parts by weight) | Result |
|---|---|---|---|---|---|
| Comp. Example | 1 | 1-0 | 29 | 0.16 | X |
| | 2 | 1-0 | 29 | 0.6 | X |
| | 3 | 1-0 | 29 | 0.9 | X |
| | 4 | 1-1 | 29 | 0.16 | Δ |
| | 5 | 1-1 | 29 | 0.6 | Δ |
| | 6 | 1-1 | 29 | 0.9 | X |
| | 7 | 1-2 | 29 | 0.16 | Δ |
| | 8 | 1-2 | 29 | 0.6 | X |
| | 9 | 1-2 | 29 | 0.9 | X |
| | 10 | 1-3 | 29 | 0.16 | Δ |
| | 11 | 1-3 | 29 | 0.6 | Δ |
| | 12 | 1-3 | 29 | 0.9 | X |
| | 13 | 1-0 | 30 | 0.16 | Δ |
| | 14 | 1-0 | 30 | 0.6 | X |
| | 15 | 1-0 | 30 | 0.9 | X |
| | 16 | 1-1 | 30 | 0.16 | Δ |
| | 17 | 1-1 | 30 | 0.6 | Δ |
| | 18 | 1-1 | 30 | 0.9 | Δ |
| | 19 | 1-2 | 30 | 0.16 | Δ |
| | 20 | 1-2 | 30 | 0.6 | X |
| | 21 | 1-2 | 30 | 0.9 | X |
| | 22 | 1-3 | 30 | 0.16 | Δ |
| | 23 | 1-3 | 30 | 0.6 | X |
| | 24 | 1-3 | 30 | 0.9 | X |

Example II

<Oxidation Stability Test of Lubricating Oil for Internal Combustion Engines>

Oxidation/degradation tests of lubricating oils for internal combustion engines were carried out for the lubricating oil composition of the present invention and of the Comparative Examples having the composition described in Tables 3 and 4, and the residual amount of MoDTC in the oils after the tests was measured by high performance liquid chromatography or the coefficient of friction was measured by an SRV tester so as to measure the lubricating properties after degradation.

The oxidation stability tests for the lubricating oil for internal combustion engines were carried out in accordance with JIS K 2514. That is, the sample oils were allowed to undergo oxidation and degradation by keeping the temperature of a thermostat at 165.5° C. and stirring the solution by rotating a sample stirring rod at 1,300 rpm for 48 hours.

<Frictional Coefficient Measurement Test>

A frictional coefficient measurement test was carried out under the following conditions by using an SRV measurement tester.

Line contact: The test was carried out under the cylinder-on-plate line contact condition. That is, an upper cylinder (ϕ15×22 mm) was vertically set on a plate (ϕ24×6.85 mm) in a sliding condition and was reciprocated so as to measure the coefficient of friction. The material of both the cylinder and plate was SUJ-2.

Load: 200N

Temperature: 80° C.

Measurement: 15 minutes

Amplitude: 1 mm

Cycle: 50 Hz

The results are summarized in Tables 3 and 4.

TABLE 3

| | MoDTC amount per 100 parts by weight of base oil and test values | | | | | |
|---|---|---|---|---|---|---|
| | Base Oil | MoDTC | | | Coefficient of Friction | |
| Test No. | Sample No. | Sample No. | Amount Added | Residual Mo (%) | Before Degradation | After Degradation |
| 1 | 1-0 | 1 | 0.1 | 62 | 0.065 | 0.060 |
| 2 | 1-0 | 1 | 0.4 | 60 | 0.065 | 0.050 |
| 3 | 1-0 | 1 | 1.5 | 74 | 0.070 | 0.060 |
| 4 | 1-0 | 1 | 2.8 | 74 | 0.070 | 0.060 |
| 5 | 1-0 | 2 | 0.1 | 60 | 0.070 | 0.075 |
| 6 | 1-0 | 2 | 1.5 | 75 | 0.065 | 0.065 |
| 7 | 1-1 | 1 | 0.1 | 60 | 0.065 | 0.075 |
| 8 | 1-1 | 1 | 1.5 | 70 | 0.065 | 0.055 |
| 9 | 1-1 | 2 | 0.1 | 60 | 0.065 | 0.060 |
| 10 | 1-1 | 2 | 1.5 | 68 | 0.065 | 0.060 |
| 11 | 1-2 | 1 | 0.1 | 60 | 0.065 | 0.075 |
| 12 | 1-2 | 1 | 1.5 | 73 | 0.070 | 0.065 |
| 13 | 1-2 | 2 | 0.1 | 62 | 0.065 | 0.075 |
| 14 | 1-2 | 2 | 1.5 | 70 | 0.070 | 0.060 |
| 15 | 1-3 | 1 | 0.1 | 61 | 0.065 | 0.075 |
| 16 | 1-3 | 1 | 1.5 | 72 | 0.065 | 0.065 |
| 17 | 1-3 | 2 | 0.1 | 60 | 0.065 | 0.075 |
| 18 | 1-3 | 2 | 1.5 | 70 | 0.070 | 0.065 |

TABLE 4

| | Amount of Comparative Samples and test values | | | | | |
|---|---|---|---|---|---|---|
| | Base Oil | MoDTC | | | Coefficient of Friction | |
| Test No. | Sample No. | Sample No. | Amount Added | Residual Mo (%) | Before Degradation | After Degradation |
| 1 | 1-0 | 29 | 0.01 | 0 | 0.100 | 0.130 |
| 2 | 1-0 | 29 | 0.4 | 50 | 0.065 | 0.080 |
| 3 | 1-0 | 30 | 0.4 | 0 | 0.065 | 0.130 |
| 4 | 1-1 | 29 | 0.4 | 45 | 0.065 | 0.080 |
| 5 | 1-1 | 30 | 0.4 | 0 | 0.070 | 0.130 |
| 6 | 1-2 | 29 | 0.4 | 40 | 0.065 | 0.080 |
| 7 | 1-2 | 30 | 0.4 | 0 | 0.070 | 0.130 |
| 8 | 1-3 | 29 | 0.4 | 50 | 0.065 | 0.085 |
| 9 | 1-3 | 30 | 0.4 | 0 | 0.065 | 0.130 |
| 10 | 1-4 | 1 | 0.4 | 40 | 0.065 | 0.080 |
| 11 | 1-4 | 2 | 0.4 | 35 | 0.065 | 0.085 |
| 12 | 1-4 | 29 | 0.4 | 15 | 0.065 | 0.100 |
| 13 | 1-4 | 30 | 0.4 | 0 | 0.065 | 0.130 |

Example III

Next, the lubricating oil compositions according to the present invention and those of the Comparative Examples were prepared in the blending proportions shown in Tables 5-1 to 5-4, respectively, and an oxidation stability test for the lubricating oil for an internal combustion engine and a frictional coefficient measurement test were carried out as described above. The results were summarized in Tables 6-1 to 6-4.

TABLE 5-1

Blending table of Examples

| | | Amount added of each component per 100 parts by weight of base oil (parts by weight) | | | | | | | |
|---|---|---|---|---|---|---|---|---|---|
| | Base Oil | (A) | | (B) | | (C) | | (D) | |
| Test No. | Sample No. | Sample No. | Amount added | Sample No. | Amount added | Sample No. | Amount added | Sample No. | Amount added |
| 1 | 1-0 | 1 | 0.4 | 4 | 1.0 | | — | | — |
| 2 | 1-0 | 1 | 0.4 | 4 | 1.0 | | — | 9 | 1.0 |
| 3 | 1-0 | 1 | 0.4 | 4 | 1.0 | | — | 9 | 1.0 |
| 4 | 1-0 | 1 | 0.4 | 3 | 1.0 | | — | 9 | 1.0 |
| 5 | 1-0 | 1 | 0.4 | 3 | 1.0 | | — | 9 | 1.0 |
| 6 | 1-0 | 1 | 0.4 | 4 | 1.0 | | — | 9 | 1.0 |
| 7 | 1-0 | 1 | 0.4 | 5 | 1.0 | | — | 9 | 1.0 |
| 8 | 1-0 | 1 | 0.4 | 6 | 1.0 | | — | 9 | 1.0 |
| 9 | 1-0 | 1 | 0.4 | | — | 7 | 1.0 | 9 | 1.0 |
| 10 | 1-0 | 1 | 0.4 | | — | 8 | 1.0 | 9 | 1.0 |
| 11 | 1-0 | 1 | 0.4 | 3 | 1.0 | | — | 9 | 0.6 |
| | | | | | | | | 10 | 0.4 |
| 12 | 1-0 | 1 | 0.4 | | — | 7 | 1.0 | 9 | 0.7 |
| | | | | | | | | 11 | 0.3 |
| 13 | 1-1 | 1 | 0.4 | 3 | 1.0 | | | 9 | 1.0 |
| 14 | 1-1 | 1 | 0.4 | | — | 8 | 1.0 | 9 | 1.0 |
| 15 | 1-1 | 1 | 0.4 | 3 | 1.0 | | — | 9 | 1.0 |
| 16 | 1-1 | 1 | 0.4 | | | 7 | 1.0 | 9 | 1.0 |
| 17 | 1-1 | 1 | 0.4 | 3 | 1.0 | | — | 9 | 1.0 |
| 18 | 1-1 | 1 | 0.4 | | — | 8 | 1.0 | 9 | 1.0 |
| 19 | 1-0 | 1 | 0.4 | 3 | 1.0 | | — | 9 | 1.0 |
| 20 | 1-0 | 1 | 0.4 | 3 | 1.0 | | — | 9 | 1.0 |
| 21 | 1-0 | 1 | 0.4 | 3 | 1.0 | | — | 9 | 1.0 |

| | Amount added of each component per 100 parts by weight of base oil (parts by weight) | | | | | |
|---|---|---|---|---|---|---|
| | (E) | | (F) | | (G) | |
| Test No. | Sample No. | Amount added | Sample No. | Amount added | Sample No. | Amount added |
| 1 | | — | | — | | — |
| 2 | | — | | — | | — |
| 3 | 12 | 1.0 | | — | | — |
| 4 | 12 | 1.0 | 15 | 2.4 | | — |
| 5 | 12 | 1.0 | 15 | 2.4 | 18 | 1.0 |
| 6 | 12 | 1.0 | 15 | 2.4 | 18 | 1.0 |
| 7 | 12 | 1.0 | 15 | 2.4 | 18 | 1.0 |
| 8 | 12 | 1.0 | 15 | 2.4 | 18 | 1.0 |
| 9 | 12 | 1.0 | 15 | 2.4 | 18 | 1.0 |
| 10 | 12 | 1.0 | 15 | 2.4 | 18 | 1.0 |
| 11 | 12 | 1.0 | 15 | 2.4 | 18 | 1.0 |
| 12 | | | | | | |
| | 12 | 1.0 | 15 | 2.4 | 18 | 1.0 |
| 13 | 31 | 1.0 | 15 | 2.4 | 18 | 1.0 |
| 14 | 14 | 1.0 | 15 | 2.4 | 18 | 1.0 |
| 15 | 31 | 1.0 | 16 | 2.4 | 18 | 1.0 |
| 16 | 12 | 1.0 | 17 | 2.4 | 18 | 1.0 |
| 17 | 12 | 1.0 | 17 | 2.4 | 19 | 1.0 |
| 18 | 14 | 1.0 | 15 | 2.4 | 20 | 1.0 |
| 19 | 12 | 1.0 | 17 | 2.4 | 21 | 1.0 |
| 20 | 12 | 1.0 | 17 | 2.4 | 22 | 1.0 |
| 21 | 12 | 1.0 | 17 | 2.4 | 23 | 1.0 |

TABLE 5-2

| Test No. | Base Oil Sample No. | (A) Sample No. | (A) Amount added | (B) Sample No. | (B) Amount added | (C) Sample No. | (C) Amount added | (D) Sample No. | (D) Amount added | (E) Sample No. | (E) Amount added |
|---|---|---|---|---|---|---|---|---|---|---|---|
| 22 | 1-0 | 1 | 0.4 | 3 | 1.0 | | — | 9 | 1.0 | 12 | 1.0 |
| 23 | 1-0 | 1 | 0.4 | 3 | 1.0 | | — | 9 | 1.0 | 12 | 1.0 |
| 24 | 1-0 | 1 | 0.2 | 3 | 1.0 | | — | 9 | 1.0 | 12 | 1.0 |
| 25 | 1-0 | 1 | 0.2 | 3 | 1.0 | | — | 9 | 1.0 | 12 | 1.0 |
| 26 | 1-0 | 1 | 0.4 | 3 | 1.0 | | — | 9 | 1.0 | 12 | 1.0 |
| 27 | 1-0 | 1 | 0.4 | 3 | 1.0 | | — | 9 | 1.0 | 13 | 1.0 |
| 28 | 1-0 | 1 | 0.4 | 3 | 0.5 | 7 | 0.5 | 9 | 1.0 | 13 | 1.0 |
| 29 | 1-0 | 1 | 0.4 | 3 | 1.0 | | — | 9 | 1.0 | 12 | 0.5 |
| | | | | | | | | | | 31 | 0.5 |
| 30 | 1-0 | 1 | 0.4 | 3 | 1.0 | | — | 9 | 1.0 | 12 | 1.0 |
| 31 | 1-0 | 1 | 0.4 | | — | 7 | 1.0 | 9 | 1.0 | 12 | 1.0 |
| 32 | 1-0 | 1 | 0.4 | | — | 8 | 1.0 | 9 | 1.0 | 31 | 1.0 |
| 33 | 1-2 | 1 | 0.1 | 3 | 1.0 | | — | 9 | 1.0 | 12 | 1.0 |
| 34 | 1-2 | 1 | 0.9 | | — | 7 | 1.0 | 9 | 1.0 | 12 | 1.0 |
| 35 | 1-2 | 1 | 0.4 | 5 | 0.1 | | — | 9 | 1.0 | 12 | 1.0 |
| 36 | 1-2 | 1 | 0.4 | 5 | 0.9 | | — | 9 | 1.0 | 12 | 1.0 |
| 37 | 1-2 | 1 | 0.4 | 3 | 1.0 | | — | 9 | 0.05 | 12 | 1.0 |
| 38 | 1-2 | 1 | 0.4 | | — | 8 | 1.0 | 9 | 2.7 | 12 | 1.0 |
| 39 | 1-0 | 1 | 0.4 | 5 | 1.0 | | — | 9 | 1.0 | 12 | 0.2 |
| 40 | 1-0 | 1 | 0.4 | 5 | 1.0 | | — | 9 | 1.0 | 12 | 9.0 |
| 41 | 1-0 | 1 | 0.4 | 5 | 1.0 | | — | 9 | 1.0 | 13 | 5.0 |
| 42 | 1-0 | 1 | 0.4 | 3 | 1.0 | | — | 9 | 1.0 | 13 | 1.0 |
| 43 | 1-0 | 1 | 0.4 | 3 | 1.0 | | — | 9 | 1.0 | 13 | 1.0 |
| 44 | 1-0 | 1 | 0.4 | 6 | 1.0 | | — | 9 | 1.0 | 12 | 5.0 |

| Test No. | (F) Sample No. | (F) Amount added | (G) Sample No. | (G) Amount added | (H) Sample No. | (H) Amount added | (J) Sample No. | (J) Amount added | (K) Sample No. | (K) Amount added |
|---|---|---|---|---|---|---|---|---|---|---|
| 22 | 17 | 2.4 | 24 | 1.0 | | — | | — | | — |
| 23 | 17 | 2.4 | | — | 25 | 1.0 | | — | | — |
| 24 | 17 | 2.4 | 24 | 1.0 | | — | 27 | 0.2 | | — |
| 25 | 17 | 2.4 | 24 | 1.0 | | — | | — | 28 | 0.2 |
| 26 | 17 | 2.4 | 24 | 1.0 | | — | 27 | 0.1 | 28 | 0.1 |
| 27 | 15 | 2.4 | 18 | 1.0 | | — | | — | | — |
| 28 | 16 | 2.4 | 18 | 1.0 | | — | | — | | — |
| 29 | 16 | 2.4 | 18 | 1.0 | | — | | — | | — |
| 30 | 15 | 1.2 | 19 | 1.0 | | — | | — | | — |
| | 17 | 1.2 | | | | | | | | |
| 31 | 17 | 2.4 | 18 | 0.5 | | — | | — | | — |
| | | | 19 | 0.5 | | | | | | |
| 32 | 16 | 2.4 | 22 | 0.5 | | — | | — | | — |
| | | | 23 | 0.5 | | | | | | |
| 33 | 15 | 2.4 | 18 | 1.0 | | — | | — | | — |
| 34 | 15 | 2.4 | 18 | 1.0 | | — | | — | | — |
| 35 | 15 | 2.4 | 18 | 1.0 | | — | | — | | — |
| 36 | 15 | 2.4 | 18 | 1.0 | | — | | — | | — |
| 37 | 15 | 2.4 | 18 | 1.0 | | — | | — | | — |
| 38 | 15 | 2.4 | 18 | 1.0 | | — | | — | | — |
| 39 | 15 | 2.4 | 18 | 1.0 | | — | | — | | — |
| 40 | 15 | 2.4 | 18 | 1.0 | | — | | — | | — |
| 41 | 15 | 2.4 | 18 | 1.0 | | — | | — | | — |
| 42 | 16 | 5.0 | 18 | 1.0 | | — | | — | | — |
| 43 | 16 | 5.0 | 18 | 0.05 | | — | | — | | — |
| 44 | 15 | 2.4 | 18 | 8.0 | | — | | — | | — |

TABLE 5-3

| Test No. | Base Oil Sample No. | (A) Sample No. | (A) Amount added | (B) Sample No. | (B) Amount added | (C) Sample No. | (C) Amount added | (D) Sample No. | (D) Amount added | (E) Sample No. | (E) Amount added |
|---|---|---|---|---|---|---|---|---|---|---|---|
| 45 | 1-3 | 1 | 0.4 | 6 | 0.1 | | — | 9 | 1.0 | 12 | 1.0 |
| 46 | 1-3 | 1 | 0.4 | 5 | 1.9 | | — | 9 | 1.0 | 13 | 1.0 |
| 47 | 1-3 | 1 | 0.4 | 3 | 1.0 | | — | 9 | 1.0 | 13 | 1.0 |
| 48 | 1-3 | 1 | 0.4 | 3 | 1.0 | | — | 9 | 1.0 | 13 | 1.0 |
| 49 | 1-0 | 2 | 0.4 | 3 | 1.0 | | — | 9 | 1.0 | 13 | 1.0 |
| 50 | 1-0 | 2 | 0.4 | 3 | 1.0 | | — | 9 | 1.0 | 13 | 1.0 |
| 51 | 1-0 | 1 | 0.3 | 3 | 1.0 | | — | 9 | 1.0 | 13 | 1.0 |
| 52 | 1-0 | 1 | 0.6 | 3 | 1.0 | | — | 9 | 1.0 | 13 | 1.0 |
| 53 | 1-0 | 1 | 0.4 | 3 | 0.5 | 7 | 0.5 | 9 | 1.0 | 13 | 1.0 |
| 54 | 1-0 | 2 | 0.4 | 3 | 1.0 | | — | 9 | 1.0 | 31 | 1.0 |
| 55 | 1-0 | 2 | 0.2 | 3 | 0.5 | 7 | 0.5 | 9 | 1.0 | 13 | 1.0 |
| 56 | 1-0 | 2 | 0.4 | 3 | 1.0 | | — | 9 | 1.0 | 13 | 1.0 |
| 57 | 1-0 | 2 | 0.4 | | — | 8 | 1.0 | 9 | 1.0 | 13 | 1.0 |
| 58 | 1-0 | 2 | 0.4 | 3 | 0.5 | 8 | 0.5 | 9 | 1.0 | 13 | 1.0 |
| 59 | 1-0 | 2 | 0.3 | | — | 8 | 1.0 | 9 | 1.0 | 13 | 1.0 |
| 60 | 1-0 | 1 | 0.4 | | — | 7 | 1.0 | | — | | — |
| 61 | 1-0 | 1 | 0.4 | | — | | — | 9 | 1.0 | | — |
| 62 | 1-0 | 1 | 0.4 | | — | | — | | — | 12 | 1.0 |
| 63 | 1-0 | 1 | 0.4 | | — | | — | | — | | — |
| 64 | 1-0 | 1 | 0.4 | | — | | — | | — | | — |
| 65 | 1-0 | 1 | 0.4 | | — | | — | | — | | — |
| 66 | 1-0 | 1 | 0.4 | 3 | 1.0 | | — | 9 | 1.0 | 12 | 1.0 |

| Test No. | (F) Sample No. | (F) Amount added | (G) Sample No. | (G) Amount added | (H) Sample No. | (H) Amount added | (J) Sample No. | (J) Amount added | (K) Sample No. | (K) Amount added |
|---|---|---|---|---|---|---|---|---|---|---|
| 45 | 15 | 2.4 | 18 | 1.0 | | — | | — | | — |
| 46 | 16 | 2.4 | 18 | 1.0 | | — | | — | | — |
| 47 | 16 | 0.1 | 18 | 1.0 | | — | | — | | — |
| 48 | 16 | 0.7 | 18 | 1.0 | | — | | — | | — |
| 49 | 15 | 2.4 | 18 | 1.0 | | — | | — | | — |
| 50 | 16 | 2.4 | 18 | 1.0 | | — | | — | | — |
| 51 | 15 | 2.4 | 18 | 1.0 | | — | | — | | — |
| 52 | 16 | 2.4 | 18 | 1.0 | | — | | — | | — |
| 53 | 16 | 2.4 | | — | 25 | 1.0 | | — | | — |
| 54 | 15 | 2.4 | 18 | 1.0 | | — | | — | | — |
| 55 | 16 | 2.4 | | — | | — | 26 | 0.2 | | — |
| 56 | 17 | 2.4 | | — | 25 | 1.0 | | — | | — |
| 57 | 17 | 2.4 | 24 | 1.0 | 25 | 1.0 | | — | | — |
| 58 | 16 | 2.4 | | — | | — | | — | | — |
| 59 | 16 | 2.4 | | — | | — | | — | 28 | 0.1 |
| 60 | | — | | — | | — | | — | | — |
| 61 | | — | | — | | — | | — | | — |
| 62 | | — | | — | | — | | — | | — |
| 63 | 15 | 2.4 | | — | | — | | — | | — |
| 64 | | — | 18 | 1.0 | | — | | — | | — |
| 65 | | — | | — | 25 | 1.0 | | — | | — |
| 66 | 15 | 2.4 | 18 | 1.0 | 32 | 1.0 | | — | | — |

TABLE 5-4

Blending table of Comparative Examples

Amount added of each component per 100 parts by weight of base oil (parts by weight)

| Test No. | Base Oil Sample No. | (A) Sample No. | (A) Amount added | (B) Sample No. | (B) Amount added | (C) Sample No. | (C) Amount added | (D) Sample No. | (D) Amount added | (E) Sample No. | (E) Amount added |
|---|---|---|---|---|---|---|---|---|---|---|---|
| 1 | 1-0 | 29 | 0.4 | 3 | 1.0 | | — | 9 | 1.0 | 12 | 1.0 |
| 2 | 1-0 | 30 | 0.4 | 3 | 1.0 | | — | 9 | 1.0 | 12 | 1.0 |
| 3 | 1-0 | 29 | 0.4 | 3 | 1.0 | | — | 10 | 1.0 | | — |
| 4 | 1-0 | 30 | 0.4 | 3 | 1.0 | | — | 9 | 1.0 | | — |
| 5 | 1-1 | 29 | 0.4 | | — | 7 | 1.0 | 11 | 1.0 | | — |
| 6 | 1-1 | 30 | 0.4 | | — | 8 | 1.0 | 10 | 1.0 | | — |
| 7 | 1-1 | 29 | 0.4 | 4 | 1.0 | | — | 11 | 1.0 | | — |

TABLE 5-4-continued

Blending table of Comparative Examples

| | | | | | | | | | | | |
|---|---|---|---|---|---|---|---|---|---|---|---|
| 8 | 1-4 | 1 | 0.4 | 3 | 1.0 | | — | 10 | 1.0 | 12 | 1.0 |
| 9 | 1-4 | 1 | 0.4 | | — | 7 | 1.0 | 11 | 1.0 | 13 | 1.0 |
| 10 | 1-4 | 1 | 0.1 | 3 | 1.0 | | — | | — | | — |
| 11 | 1-4 | 1 | 0.4 | | — | | — | 9 | 0.6 | | — |
| | | | | | | | | 11 | 0.4 | | |
| 12 | 1-4 | 2 | 0.4 | 3 | 1.0 | | | 10 | 1.0 | 12 | 1.0 |
| 13 | 1-4 | 2 | 0.4 | | — | 7 | 1.0 | 11 | 1.0 | 13 | 1.0 |
| 14 | 1-4 | 2 | 0.1 | 3 | 1.0 | | — | | — | | — |
| 15 | 1-4 | 2 | 0.4 | | — | | — | 9 | 0.6 | | — |
| | | | | | | | | 11 | 0.4 | | |

| | Amount added of each component per 100 parts by weight of base oil (parts by weight) | | | | | |
|---|---|---|---|---|---|---|
| | (F) | | (G) | | (H) | |
| Test No. | Sample No. | Amount added | Sample No. | Amount added | Sample No. | Amount added |
| 1 | 15 | 2.4 | 18 | 1.0 | | — |
| 2 | 15 | 2.4 | 18 | 1.0 | | — |
| 3 | | — | | — | | — |
| 4 | | — | | — | | — |
| 5 | | — | | — | | — |
| 6 | | — | | — | | — |
| 7 | | — | | — | | — |
| 8 | 17 | 2.4 | 24 | 1.0 | 32 | 1.0 |
| 9 | 15 | 2.4 | 18 | 1.0 | | |
| 10 | | — | | — | | — |
| 11 | | — | | — | | — |
| 12 | 17 | 2.4 | 24 | 1.0 | 32 | 1.0 |
| 13 | 15 | 2.4 | 18 | 1.0 | | — |
| 14 | | — | | — | | — |
| 15 | | — | | — | | — |

TABLE 6-1

| | Test No. | Residual Mo (%) | Coefficient of Friction New Oil | Coefficient of Friction Degraded Oil |
|---|---|---|---|---|
| Example | 1 | 65 | 0.065 | 0.065 |
| | 2 | 73 | 0.065 | 0.065 |
| | 3 | 73 | 0.065 | 0.065 |
| | 4 | 74 | 0.065 | 0.065 |
| | 5 | 78 | 0.065 | 0.060 |
| | 6 | 68 | 0.065 | 0.065 |
| | 7 | 77 | 0.065 | 0.060 |
| | 8 | 75 | 0.065 | 0.060 |
| | 9 | 77 | 0.065 | 0.060 |
| | 10 | 70 | 0.065 | 0.065 |
| | 11 | 62 | 0.065 | 0.065 |
| | 12 | 60 | 0.065 | 0.065 |
| | 13 | 78 | 0.065 | 0.060 |
| | 14 | 78 | 0.065 | 0.060 |
| | 15 | 78 | 0.065 | 0.060 |
| | 16 | 77 | 0.065 | 0.060 |
| | 17 | 78 | 0.065 | 0.060 |
| | 18 | 78 | 0.065 | 0.060 |
| | 19 | 78 | 0.065 | 0.060 |
| | 20 | 78 | 0.065 | 0.060 |
| | 21 | 78 | 0.065 | 0.060 |
| | 22 | 78 | 0.065 | 0.060 |
| | 23 | 76 | 0.065 | 0.060 |

TABLE 6-2

| | Test No. | Residual Mo (%) | Coefficient of Friction New Oil | Coefficient of Friction Degraded Oil |
|---|---|---|---|---|
| Example | 24 | 63 | 0.065 | 0.065 |
| | 25 | 78 | 0.065 | 0.060 |
| | 26 | 72 | 0.065 | 0.065 |
| | 27 | 77 | 0.065 | 0.060 |
| | 28 | 74 | 0.065 | 0.065 |
| | 29 | 77 | 0.065 | 0.060 |
| | 30 | 77 | 0.065 | 0.060 |
| | 31 | 79 | 0.065 | 0.060 |
| | 32 | 76 | 0.065 | 0.060 |
| | 33 | 72 | 0.065 | 0.065 |
| | 34 | 77 | 0.065 | 0.060 |
| | 35 | 72 | 0.065 | 0.065 |
| | 36 | 78 | 0.065 | 0.060 |
| | 37 | 63 | 0.065 | 0.065 |
| | 38 | 75 | 0.075 | 0.075 |
| | 39 | 72 | 0.065 | 0.065 |
| | 40 | 72 | 0.075 | 0.075 |
| | 41 | 74 | 0.070 | 0.070 |
| | 42 | 72 | 0.070 | 0.070 |
| | 43 | 74 | 0.065 | 0.065 |
| | 44 | 72 | 0.075 | 0.075 |
| | 45 | 68 | 0.065 | 0.065 |
| | 46 | 74 | 0.070 | 0.070 |

TABLE 6-3

| | Test No. | Residual Mo (%) | Coefficient of Friction New Oil | Coefficient of Friction Degraded Oil |
|---|---|---|---|---|
| Example | 47 | 74 | 0.065 | 0.065 |
| | 48 | 75 | 0.070 | 0.065 |
| | 49 | 60 | 0.065 | 0.065 |
| | 50 | 62 | 0.065 | 0.065 |
| | 51 | 73 | 0.065 | 0.065 |
| | 52 | 75 | 0.065 | 0.060 |
| | 53 | 72 | 0.065 | 0.065 |
| | 54 | 65 | 0.065 | 0.065 |
| | 55 | 67 | 0.065 | 0.065 |
| | 56 | 70 | 0.065 | 0.065 |
| | 57 | 70 | 0.065 | 0.065 |
| | 58 | 69 | 0.065 | 0.065 |
| | 59 | 67 | 0.065 | 0.065 |
| | 60 | 65 | 0.065 | 0.065 |
| | 61 | 66 | 0.065 | 0.065 |
| | 62 | 60 | 0.065 | 0.065 |
| | 63 | 62 | 0.065 | 0.065 |
| | 64 | 61 | 0.065 | 0.065 |
| | 65 | 60 | 0.065 | 0.065 |
| | 66 | 70 | 0.065 | 0.065 |

TABLE 6-4

| | Test No. | Residual Mo (%) | Coefficient of Friction New Oil | Coefficient of Friction Degraded Oil |
|---|---|---|---|---|
| Comp. Example | 1 | 50 | 0.065 | 0.08 |
| | 2 | 0 | 0.065 | 0.13 |
| | 3 | 50 | 0.065 | 0.08 |
| | 4 | 0 | 0.065 | 0.13 |
| | 5 | 20 | 0.065 | 0.1 |
| | 6 | 0 | 0.065 | 0.13 |
| | 7 | 0 | 0.065 | 0.13 |
| | 8 | 0 | 0.065 | 0.13 |
| | 9 | 0 | 0.065 | 0.13 |
| | 10 | 35 | 0.065 | 0.13 |
| | 11 | 35 | 0.065 | 0.085 |
| | 12 | 0 | 0.065 | 0.13 |
| | 13 | 0 | 0.065 | 0.13 |
| | 14 | 10 | 0.065 | 0.10 |
| | 15 | 20 | 0.065 | 0.13 |

The lubricating oil composition wherein the alkyl group asymmetric type MoDTC is the essential component according to the present invention provides the effect that it can provide excellent friction mitigation performance from the initial stages of use to degradation.

What is claimed is:

1. a lubricating oil composition comprising:

a base oil for a lubricating oil consisting of a mineral oil and/or a synthetic oil, having a viscosity index of at least 115, and having a viscosity of 2 to 50 Cst at 100° C.; and a molybdenum dithiocarbamate expressed by the following general formula (1) as Component (A) :

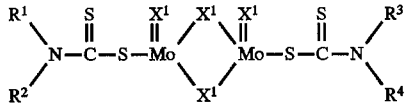

(1)

wherein both $R^1$ and $R^2$ each represent a $C_8$ to $C_{13}$ alkyl group having a branched chain, both $R^3$ and $R^4$ each represent a $C_8$ to $C_{13}$ alkyl group having a branched chain and/or a straight chain, with the provision that, $R^1$ and $R^2$ are the same, $R^3$ and $R^4$ are the same, and $R^1$ is different from $R^3$, and $X^1$ represents a sulfur atom or oxygen atom.

2. The lubricating oil compositon according to claim 1, which contains at least one component selected from the group consisting of the following Components (B) to (K) in the amount stipulated based on 100 parts by weight of said base oil for the lubricating oil:

Component (B): 0.05 to 2 parts by weight of at least one kind of phenolic compound;

Component (C): 0.05 to 2 parts by weight of at least one kind of aromatic amine compound;

Component (D): 0.01 to 3 parts by weight of at least one kind of zinc dithiophosphate;

Component (E): 0.1 to 10 parts by weight of at least one kind of metal detergent;

Component (F): 0.05 to 15 parts by weight of at least one kind of ashless dispersant;

Component (G): 0.1 to 10 parts by weight of at least one kind of polyol half ester;

Component (H): 0.01 to 5 parts by weight of at least one kind of carboxylic acid amide;

Component (J): 0.01 to 1 parts by weight of at least one kind of molybdenum dithiophosphate; and Component (K): 0.01 to 1 parts by weight of at least one kind of molybdic acid amine salt.

3. The lubricating oil composition according to claim 2, wherein said phenolic compound as Component (B) is expressed by the following general formula (2):

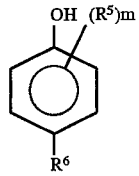

(2)

wherein $R^5$ represents a $C_1$ to $C_8$ hydrocarbon group which may contain a hydrogen atom or oxygen atom which may be separately the same or different, but wherein no $R^5$ is simultaneously a hydrogen atom, m is an integer from 2 to 4, and $R^6$ represents a $C_1$ to $C_{24}$ hydrocarbon group which may contain an ester bond or ether bond; or by the following general formula (3):

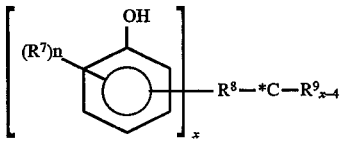

(3)

wherein $R^7$ and $R^9$ each represent a $C_1$ to $C_8$ hydrocarbon group which may contain a hydrogen atom or oxygen atom which may be separately the same or different, but wherein none of $R^7$ and $R^9$ are simultaneously a hydrogen atom, n is an integer from 2 to 4, x is an integer from 2 to 4, the phenolic derivatives inside the parenthesis may be the same or different, and $R^8$ represents a hydrocarbon group which may contain an ester bond or ether bond but which may be absent altogether.

4. The lubricating oil composition according to claim 2, wherein said aromatic amine compound as Component (C) is expressed by the following general formula (4):

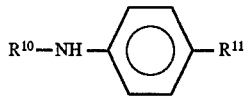

(4)

wherein both $R^{10}$ and $R^{11}$ represent a $C_1$ to $C_{20}$ alkyl group which may contain a nitrogen atom and/or oxygen atom, an aryl group, naphthyl group, alkyl-substituted aryl group, alkyl-substituted naphthyl group or heterocyclic ring-containing group.

5. The lubricating oil composition according to claim 2, wherein said zinc dithiophosphate as Component (D) is at least one kind of neutral or basic zinc dithiophosphate expressed by the following general formula (5):

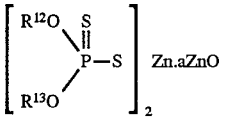

(5)

wherein a is 0 or 1/3, and $R^{12}$ and $R^{13}$ represent a $C_3$ to $C_{14}$ alkyl group and may be the same or different.

6. The lubricating oil composition according to claim 2, wherein said polyol half ester as Component (G) is expressed by the following general formula (6):

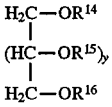

(6)

wherein y is $1 \leqq y \leqq 4$, each of $R^{14}$ to $R^{16}$ represents either a hydrogen atom, oleyl group or lauryl group, but wherein none of $R^{14}$ to $R^{16}$ are simultaneously a hydrogen atom, oleyl group or lauryl group, and when $y \neq 1$, a plurality of $R^{15}$s separately represent a hydrogen atom, oleyl group or lauryl group.

7. The lubricating oil composition according to claim 2, wherein said carboxylic acid amide as Component (H) is expressed by the following general formula (7):

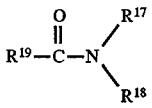

(7)

wherein both $R^{17}$ and $R^{18}$ each represent a hydrogen atom, $C_1$ to $C_{24}$ hydrocarbon group or $C_2$ to $C_{30}$ alkyleneoxide group, which may be the same or different, and wherein $R^{19}$ represents a hydrogen atom or $C_1$ to $C_{24}$ hydrocarbon group which may contain an ether bond, ester bond or carbonyl group, and whose hydrogen atom may be substituted by a hydroxyl group.

8. The lubricating oil composition according to claim 2, wherein said molybdenum dithiophosphate as Component (J) is expressed by the following general formula (8):

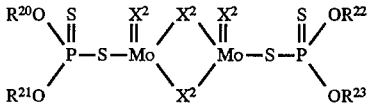

(8)

wherein $R^{20}$ to $R^{23}$ are each a $C_1$ to $C_{16}$ alkyl group which may be the same or different, and $X^2$ represents a sulfur atom or oxygen atom.

9. The lubricating oil composition according to claim 2, wherein said molybdic acid amine salt as Component (K) is expressed by the following general formula (9):

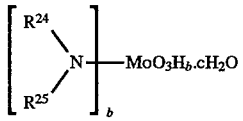

(9)

wherein $R^{24}$ and $R^{25}$ are each a $C_1$ to $C_{16}$ alkyl group and may be the same or different, b is a number satisfying the relation $0.95 \leqq b \leqq 1.05$ and c is a number satisfying the relation $0 \leqq c \leqq 1$.

10. The lubricating oil composition according to claim 1, wherein $X^1$ in the general formula (1) is a sulfur atom or oxygen atom and the ratio of the sulfur atom to the oxygen atom is 1/3 to 3/1.

11. The lubricating oil composition according to claim 1, wherein said base oil for the lubricating oil comprises a mineral oil having an aromatic component of not greater than 5% and a sulfur content of not greater than 100 ppm by hydrogenation purification, and/or a synthetic oil consisting of a poly-alpha-olefin prepared from $C_4$ to $C_{16}$ alpha-olefins and having a mean molecular weight of 300 to 2,500 and/or a polyol ester having a molecular weight of 200 to 1,200 and/or a diester having a molecular weight of 200 to 700.

12. The lubricating oil composition according to claim 1, which contains 0.01 to 3 parts by weight of said molybdenum dithiocarbamate expressed by the general formula (1) as Component (A) on the basis of 100 parts by weight of said base oil for the lubricating oil.

13. The lubricating oil composition according to claim 1, wherein in said molybdenum dithiocarbamate expressed by the general formula (1) as Component (A), $R^1$ and $R^2$ are the same and are a $C_8$ to $C_{13}$ alkyl group having a branched chain, $R^3$ and $R^4$ are the same and are a $C_8$ to $C_{13}$ alkyl group having a branched or straight chain, and $R^1$ and $R^2$ are a different alkyl group from the alkyl group of $R^3$ and $R^4$.

14. A lubricating oil composition for an internal combustion engine comprising said lubricating oil composition defined in according to claim 1 as a principal constituent component thereof.

* * * * *